US005427832A

United States Patent [19]

Longtin

[11] Patent Number: 5,427,832

[45] Date of Patent: Jun. 27, 1995

[54] CARD POCKET

[75] Inventor: Andre G. Longtin, Weare, N.H.

[73] Assignee: Moore Business Forms, Inc., Grand Island, N.Y.

[21] Appl. No.: 155,759

[22] Filed: Nov. 23, 1993

[51] Int. Cl.[6] ..... B65D 27/04

[52] U.S. Cl. ..... 428/40; 229/69; 229/71; 229/92.1; 229/92.3; 283/75; 283/101; 283/904; 428/43; 428/68; 428/76; 428/137; 428/138; 428/140; 428/192; 428/194; 428/195; 428/201

[58] Field of Search ..... 428/40, 202, 138, 43, 428/76, 68, 137, 140, 192, 194, 201, 195; 283/75, 101, 904; 229/69, 71, 92.1, 92.3, 315, 316

[56] References Cited

U.S. PATENT DOCUMENTS

| | | | |
|---|---|---|---|
| 3,068,140 | 12/1962 | Biddle | 156/227 |
| 3,140,816 | 7/1964 | Schultz | 229/69 |
| 3,697,101 | 10/1972 | Loos et al. | 283/62 |
| 3,726,471 | 4/1973 | Kalb | 229/92.8 |
| 4,544,590 | 10/1985 | Egan | 428/40 |
| 4,854,610 | 8/1989 | Kwiatek | 283/11 |
| 4,890,862 | 1/1990 | Buchholz | 283/62 |
| 4,925,716 | 5/1990 | Haas | 428/41 |
| 4,982,894 | 1/1991 | Schmidt | 229/69 |
| 5,058,926 | 10/1991 | Drower | 283/109 |
| 5,096,229 | 3/1992 | Carlson | 283/75 |
| 5,131,686 | 7/1992 | Carlson | 283/75 |
| 5,198,275 | 3/1993 | Klein | 428/43 |
| 5,232,147 | 8/1993 | Weinzierl et al. | 229/69 |

FOREIGN PATENT DOCUMENTS 2195611 4/1988 United Kingdom .

*Primary Examiner*—Nasser Ahmad
*Attorney, Agent, or Firm*—Nixon & Vanderhye

[57] ABSTRACT

A card carrier for transport of a phone card, credit card, debit card, etc. is of paper or plastic card stock with a multi-colored design ion deposition printed on one face and a PIN and control number on the other. During production the card is part of a blow on label, attached to the rest of the label by repositional adhesive, and the blow on label is blown onto a first opaque paper carrier web inner surface, permanent adhesive affixing the label to that surface. The outer surface of the first carrier web is imaged just like the front of the card, simulating the card. A second opaque paper ply is affixed by permanent adhesive to the first ply overlying the second face of the card, but with a cutout aligned with the control number so that the control number may be viewed from exterior of the carrier. To open the carrier perforations are provided inside a permanent adhesive strip along one edge of the card, providing a tamperproof feature, i.e. an indication of if the carrier has been opened, and allowing ready access to the card within the carrier. The first and second plies typically have a surface area less than twice that of the card.

19 Claims, 4 Drawing Sheets

FIG. 2
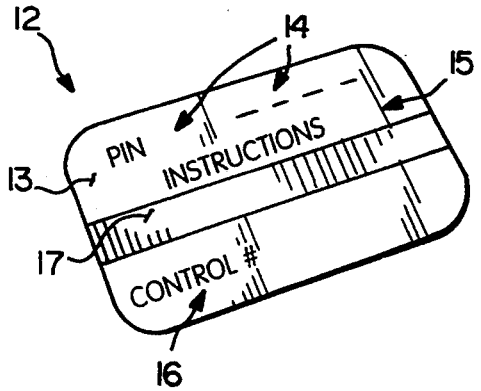
FIG. 3
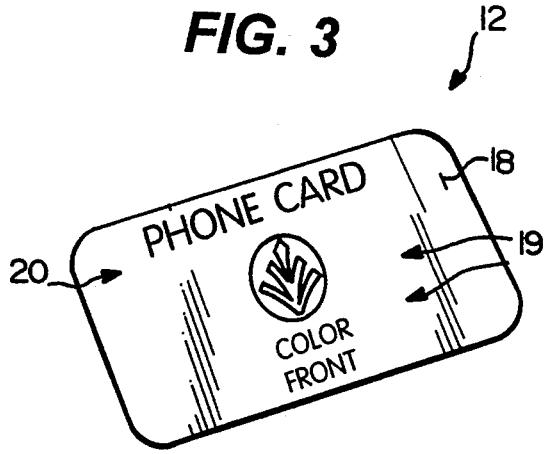
FIG. 4
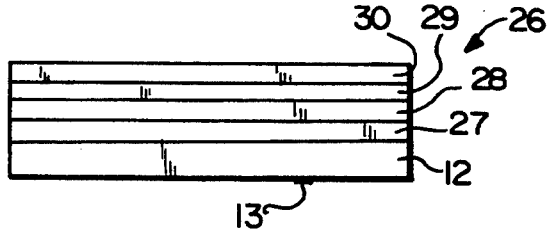
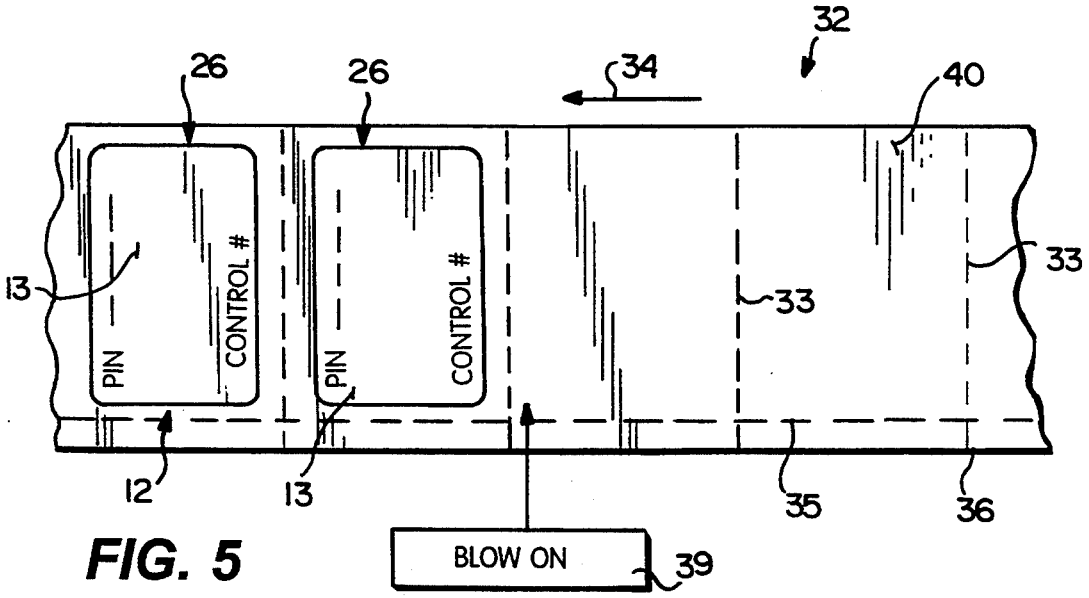
FIG. 5

CARD POCKET

BACKGROUND AND SUMMARY OF THE INVENTION

In the manufacture of card carriers for transport of cards, such as credit cards, debit cards, toll passes, transportation passes, cafeteria meal cards, pre-paid vending cards, bank cards, phone cards, and the like, it is desirable to efficiently maintain and transport the card while protecting any confidential information that may be contained on the card. However in some circumstances there is non-confidential information on the card that is desirably viewed from the exterior of the carrier, without requiring the carrier to be opened up.

According to the present invention a method is provided for the construction of a card carrier having the features described above, and according to another aspect of the present invention a card carrier itself is provided having the desirable features described above. While the invention is particularly useful in association with disposable cards, which are made of paper card stock and are used only a relatively short period of time and then discarded, the invention also is applicable to plastic credit cards, debit cards, and the like.

According to one aspect of the present invention a method of making a card carrier in a simple yet effective mariner is provided. The method comprises the steps of: (a) Imaging first and second faces of paper or plastic rectangular shaped card stock having a perimeter. (b) Coating the card first face with repositional adhesive. (c) Applying a paper cover sheet over the repositional adhesive, the paper cover sheet having an exposed face. (d) Coating the exposed face with permanent pressure sensitive adhesive, to produce a blow on label. (e) Blowing the blow-on label on a first opaque carrier web having internal and external faces so that the permanent adhesive becomes adhered to the internal face of the first carrier web. (f) Providing permanent adhesive patterns on the interior face of on one or both of the first carrier web and a second opaque carrier web of approximately the same width as the first carrier web, the patterns of adhesive outside the perimeter of the rectangular shaped card. And, (g) bringing the internal faces of the first and second carrier webs into face-to-face engagement, with the card sandwiched between them, and with the permanent adhesive patterns holding the carrier plies together around the perimeter of the card.

The method may also comprise the further steps, between steps (d) and (e), of applying a release material over the permanent adhesive, taking up a plurality of blow on labels, transporting the plurality of taken up labels to a different location, taking off the ten up blow on labels, and removing the release material from the permanent adhesive. Alternatively, or in addition, the method may comprise the still further step (h) of imaging the external face of the first carrier web so thin it has indicia thereon simulating the first face of the card, and of approximately the same size and shape as the card. Steps (h) and (a) may be practiced to provide substantially the same multi-color ion deposition image on the card first face and first carrier web external face.

Typically the carrier webs are opaque, and the method comprises the further step of printing first non-confidential indicia on the card second face, and forming a cutout in the second carrier web of substantially the same size and shape as the first non-confidential indicia: and wherein step (g) is practiced to bring the cutout in the second carrier web in alignment with the first non-confidential indicia on the card second face so that the first non-confidential indicia is visible from the exterior of the second carrier web.

According to another aspect or the present invention, a card carrier for transport of a card having confidential and non-confidential indicia thereon, so that the confidential indicia is not visible, while the non-confidential indicia is visible, from the exterior of the card carrier is provided. The carrier comprises: A card, of paper or plastic card stock, having first and second faces the second face having first non-confidential indicia thereon and at least one of the faces having confidential indicia thereon, the card of generally quadrate configuration and having a first surface area of each of the faces thereof. A first opaque paper carrier ply having an external face and an internal face, the faces each having a second surface area larger than the first surface area. Repositional adhesive operatively adhered to the first carrier ply internal face in a central portion thereof, the repositional adhesive disposed within a perimeter having approximately the same size and shape as the card, and the repositional adhesive having a greater affinity for the carrier ply than the card first face. The card first face in engagement with the repositional adhesive. A second opaque carrier ply having an external face and an internal face, the faces each having approximately the second surface area, and the second ply having a cutout therein of approximately the same size and shape as the first non-confidential indicia on the card second face. Permanent adhesive patterns disposed around the periphery, of one or both of the internal faces of the first and second plies, outside of the perimeter of the repositional adhesive. The second ply disposed so that the internal face thereof is in face-to-face engagement with the card second face and the first ply internal face with the cutout aligned with the first non-confidential indicia so that the first non-confidential indicia is visible from the exterior of the carrier, and so that the permanent adhesive patterns hold the first and second carrier plies together. And, tamperproof means facilitating separation of the first and second plies to allow access to and removal of the card from the repositional adhesive and between the plies.

The confidential indicia may comprise a PIN (personal identification number imaged on the card second face remote from the first non-confidential indicia, and the first non-confidential indicia may be a control number. The carrier ply external face preferably has indicia thereon simulating the first face of the card, and of approximately the first surface area, which indicia is preferably multi-color, decorative ion deposition printed indicia. The second surface area is preferably less than twice as great as the first surface area.

The tamperproof means facilitating separation of the first and second plies comprises aligned perforation lines disposed in the first and second plies located between an edge of the card and one of the patterns of permanent adhesive. The permanent adhesive patterns comprises a plurality of spaced dots of permanent adhesive disposed along two opposite edges of on or both of the first and second plies, and a pair of permanent adhesive strips disposed along two other opposite edges of one or both of the first and second plies, the perforation lines disposed adjacent one of the adhesive strips.

Typically the repositional adhesive is affixed to a first face of an internal ply having approximately the same size and shape as the card, and wherein a second face of the internal ply is connected by permanent adhesive to the internal face of the first ply, the internal ply first face having greater affinity for the repositional adhesive than does the card first face. The card may have confidential and non-confidential indicia thereon making the card a toll pass, transportation pass, cafeteria meal card, bank card, pre-paid vending card, phone card, debit card or credit card, and the card may comprise a high gloss finish paper card stock capable of limited use before being discarded, or may be a permanent plastic type such as a conventional credit card.

The carrier may be in a web with a plurality of like carriers. The web is elongated in a first direction, and the carriers are separated within the web by perforation lines extending through both the first a first and second ply substantially perpendicular to the direction of elongation.

According to still another respect of the present invention a card carrier for transport of a card is provided comprising: A card, of paper or plastic card stock, having first and second faces, the second face having first non-confidential indicia thereon and at least one of the faces having confidential indicia thereon, the card of generally quadrate configuration and having a first surface area of each of the faces thereof. A first opaque paper carrier ply having an external face and an internal face, the faces each having a second surface area larger than the first surface area. Repositional adhesive operatively adhered to the first carrier ply internal face in a central portion thereof, the repositional adhesive disposed within a perimeter having approximately the same size and shape as the card, and the repositional adhesive having a greater affinity for the carrier ply than for the card first face. The card first face in engagement with the repositional adhesive. A second opaque carrier ply having an external face and an internal face, the faces each having approximately the second surface area. Permanent adhesive patterns disposed around the periphery of one or both of the internal faces of the first and second plies, outside of the perimeter the repositional adhesive. The second ply disposed so that the internal face thereof is in face-to-face engagement with the card second the and the first ply internal face, and so that the permanent adhesive proteins hold the first and second carrier plies together. And, wherein the first carrier ply external face has indicia thereon simulating the first face of the card, and of approximately the first surface area.

It is the primary object of the present invention to effect the simple and advantageous production of a card carrier for transport of a phone card, debit card, credit card, or the like. This and other objects of the invention will become clear from an inspection of the detailed description of the invention, and from the appended claims.

BRIEF DESCRIPTION OF THE DRAWINGS

FIG. 2 is a rear perspective view of an exemplary card used in the method of FIG. 1;

FIG. 3 is a front perspective view of the card of FIGURE 2;

FIG. 4 is an end view of the card of FIGS. 2 and 3 when part of a blow on label, with the thickness of the elements of the label greatly exaggerated for clarity of illustration;

FIG. 5 is a top plan view of a first carrier web indicating blowing on the labels of FIG. 4 onto the web:

DETAILED DESCRIPTION OF THE DRAWINGS

Figure 1:
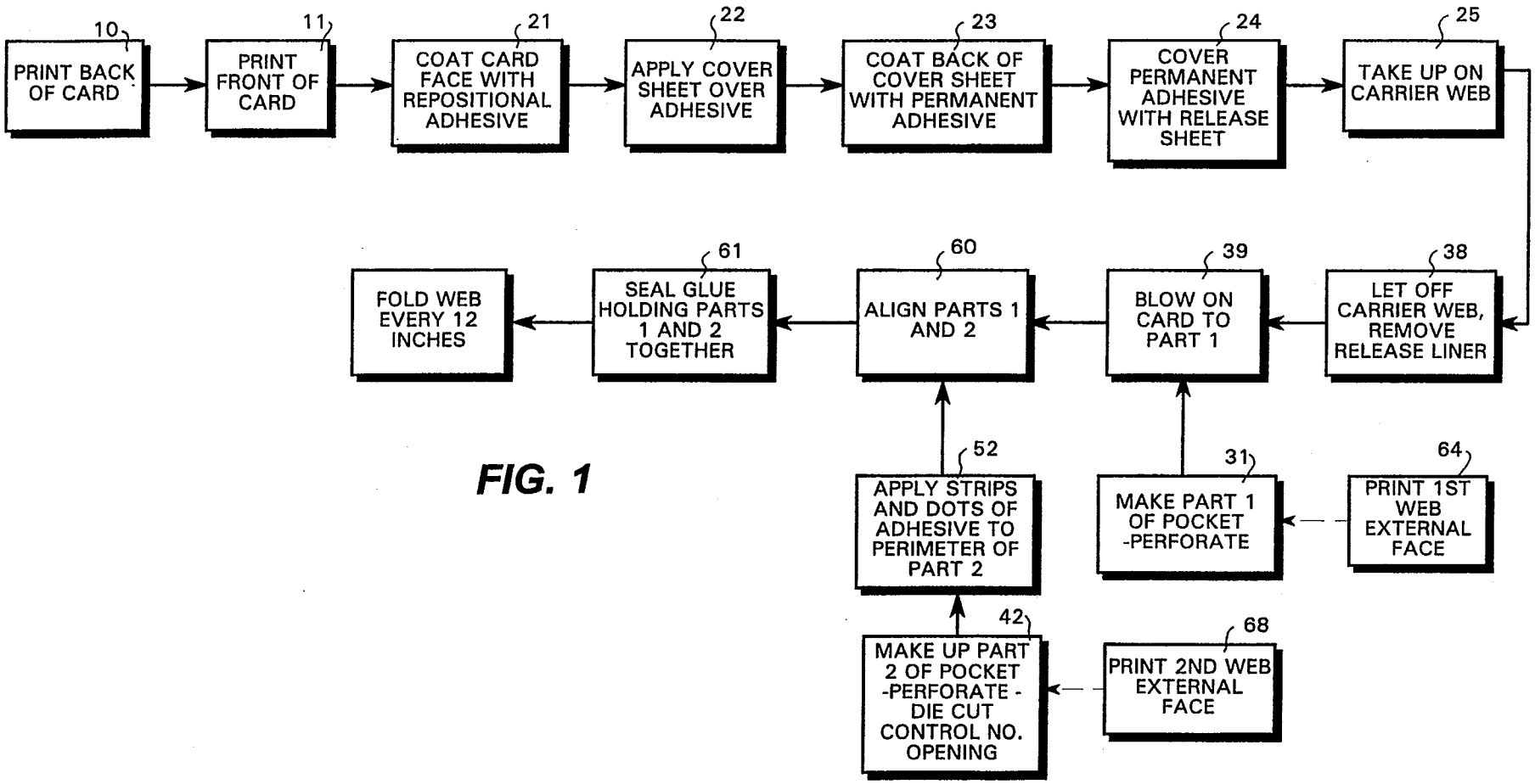
FIG. 1 is a schematic diagram showing exemplary method steps in the practice of an exemplary method according to the present invention.
Figure 8:
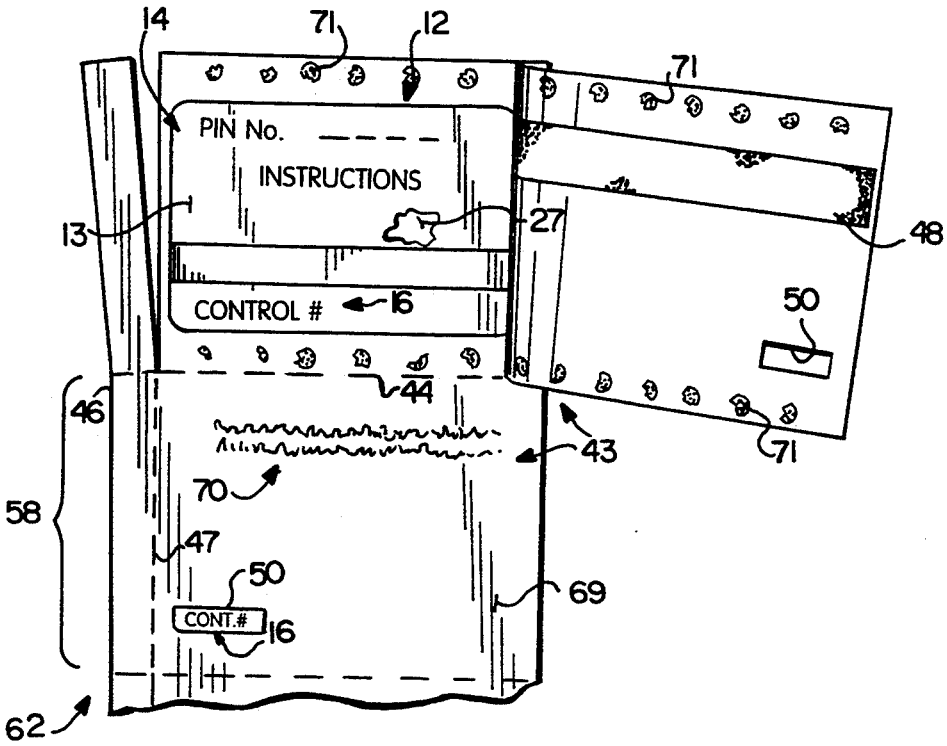
FIG. 8 is a rear view of the web of FIG. 7 showing one of the carriers opened to expose the card mounted therein.
Figure 7:
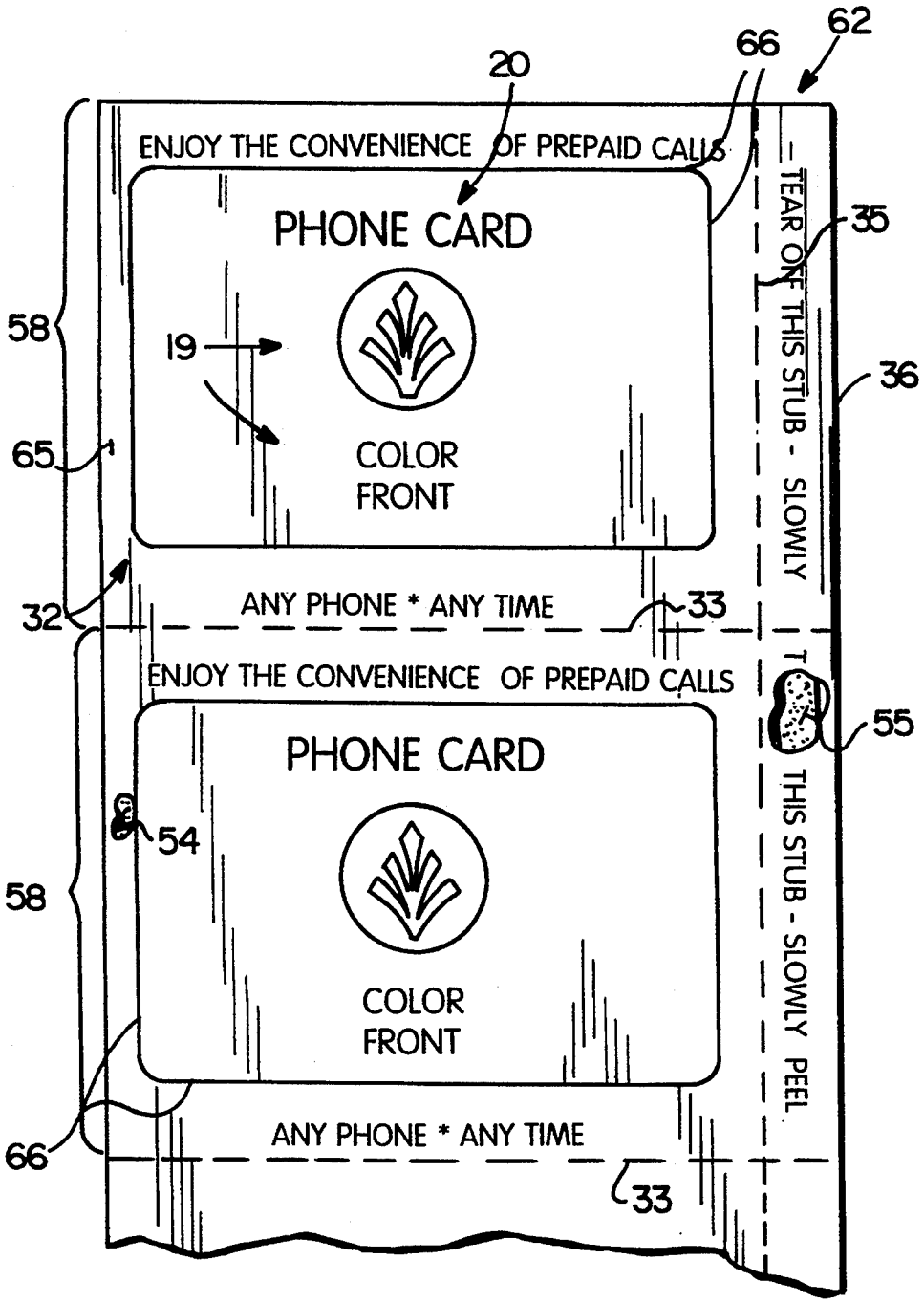
FIG. 7 is a front view of a web of carriers produced by mating the webs of FIGS. 5 and 6.

FIG. 1 illustrates schematically various method steps that may be practiced to produce the carrier of FIGS 7 and 8. First steps 10 and 11 are printing of the back and front of card stock. Preferably the card stock is between 6–15 point paper card stock, with 8–10 point stock being preferred, such as CAMPKOTE® from Union Camp of Franklin, Va. Alternatively a high gloss finish paper card stock may be used such as CHROMEKOTE®, also available from Union Camp. Alternatively plastic card stock such as used for conventional credit cards, may be used.

Printing of the back of the card stock as indicated schematically at 10, may be practiced utilizing a MIDAX ion deposition printer, and typically both confidential and non-confidential information/indicia is printed on the card back. FIG. 2 illustrates an exemplary card 12 that is printed in step 10, the card 12 having a generally quadrate (typically rectangular) configuration of a first surface area. Typically the length of the card 12 is about $3\frac{1}{3}$ inches by about $2\frac{1}{4}$ inches, or other conventional size for credit cards, phone cards or the like which are designed to fit in a user's wallet. The confidential indicia on the back 13 of the card 12 may comprise the PIN 14, and various non-confidential indicia, such as the instruction indicia 15 and a control number 16, may also be imaged on the back face 13 of the card 12. If the card 12 is plastic (e.g. a credit card), or even if paper and is used with a magnetic reader, a magnetic strip 17 of conventional configuration may be provided thereon. Printing the front of the card in step 11 typically is practiced to print multiple color, decorative ion deposition printed indicia on the card front 18 (see FIG. 3), such indicia being illustrated schematically at 19 in FIG. 3. Of course various non-confidential indicia, such as the alphanumeric indicia 20, may also be printed thereon, as well as confidential indicia if desired.

After step 11, the method comprises step 21, in which the front face of the card 12 is coated with a repositional adhesive, such as Clean-Tac® repositional adhesive from Moore Business Forms, Inc. of Lake Forest, Ill. A paper cover is applied to the repositional adhesive, such as 36 pound per ream bond paper, as illustrated at 22 in FIG. 1, and a permanent pressure sensitive adhesive, as indicated at 23, is applied to the opposite face of the cover sheet applied at 22 from the repositional adhesive. Then the permanent adhesive is covered by a release sheet as indicated at 24, and the series of blow on labels so produced are taken up on carrier web as indicated at 25. An exemplary blow on label construction produced by steps 21 through 25 is illustrated schematically at 26 in FIG. 4, comprising the repositional adhesive 27 on the front face 18 of the card 12, the paper cover sheet 28 on the repositional adhesive 27, the permanent adhesive 29 on the opposite face of the cover sheet 28, and the release sheet 30 on top of the permanent adhesive 29.

Part one of the ultimate pasted pocket construction that is to contain the card 12 is made up as indicated schematically at 31 in FIG. 1, the part one/first carrier web being shown schematically at 32 in FIG. 5. The web 32 preferably comprises conventional opaque paper stock ranging from 20–100 pounds per ream, with 28 pound stock being particularly desirable. Various perforation lines, or other lines of weakness, are provided in the web 32 at step 31 including the perforations 33 defining the web 32 into the individual carriers, extending perpendicular to the direction of movement 34 of the carrier web 32, and the perforation line 35 adjacent one side edge 36 of the web 32, in the direction of movement 34.

After the blow on label assembly 26 is taken up on the carrier web, it is transported—typically in roll configuration—to another part of the same plant, or a different plant or site, where it is let off and the release liner 30 removed, as illustrated schematically at 38 in FIG. 1. Then the blow on label assemblies 26 are blown on to carrier web 32, as indicated at step 39 in both FIGS. 1 and 5, using conventional blow-on equipment. When the label assemblies 26 are blown on to the carrier web 32 the permanent adhesive 29 becomes permanently attached to the internal face 40 of the web 32, while the cards 12 remain place because they are connected by the repositional adhesive 27 to the internal face 40 (through the carrier web 28 and the permanent adhesive 29).

The second carrier ply is constructed substantially simultaneously with step 31, as illustrated schematically at 42 in FIG. 1. In step 42, a second carrier web 43—seen in FIG. 6—is constructed, including by forming the perforation lines 44 transverse to the direction of movement 45, and perforation 47 adjacent the edge 46 extending in the direction 45. The relative positions of perforation lines 44, 47 are the same for the second web 43 as the perforation lines 33, 35 are for the first web 32, mad the webs 40, 43 typically are of the same material and weight of material (e.g. 28 pound opaque paper stock). If a higher degree of security is desired than is provided by conventional opaque stock, security printing, seen at 48 in FIGS. 6 and 8, may be provided at the portion of the internal face 49 of the carrier web 43 that will align with the PIN 14 making the final product of FIGS. 7 and 8. Also, the die cut openings 50 are formed in the web 43 during the practice of step 42, the openings 50 having generally the same size and shape (only typically slightly larger) than the control member 16 on the back face 13 of the card 12, and adapted to be aligned therewith in making the final product of FIG. 7 and 8.

Figure 6:
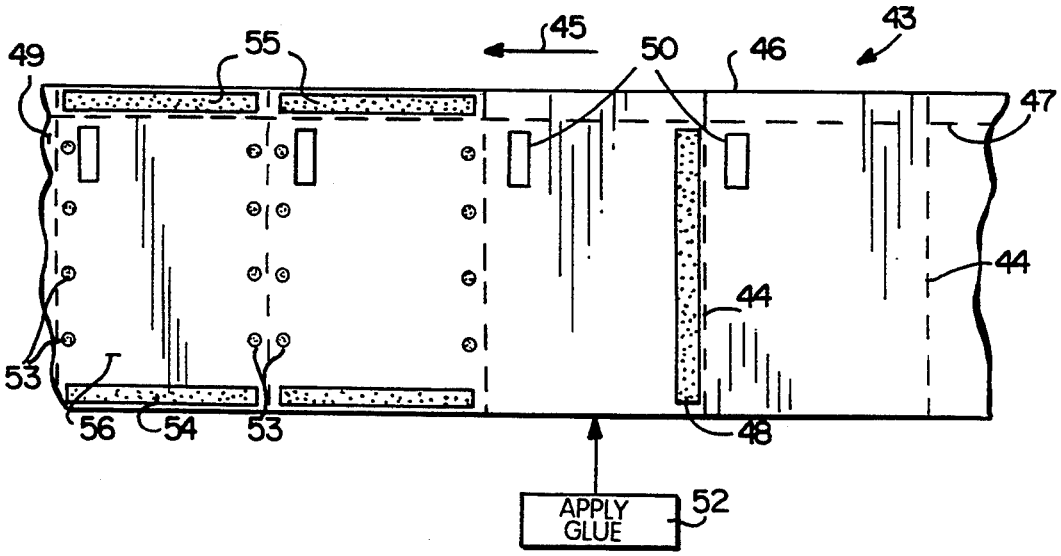
FIG. 6 is a top plan view of a second carrier web indicating schematically the application of permanent glue patterns thereto prior to mating with the carrier of FIGURE 5.

After step 42, the web 43 passes to step 52, seen in FIGS. 1 and 6, in which permanent glue is provided in pattern to the internal face 49 of the web 43. The permanent adhesive is preferably hot melt glue, and may be applied in a configuration of spaced dots as indicated at 53 in FIG. 6 parallel to the perforation lines 44, and adjacent thereto, and may be applied in the form of strips 54, 55 as seen in FIG. 6, along the opposite edges of the web 43 elongated in the direction of movement 45. The patterns 53, 55 are such that they define an interior area of the web 43, indicated schematically at 56 in FIG. 6, that is slightly larger than the first surface area (that is the surface area of the card 12).

It is desirable that the steps 31, 42, 52 be practiced so that individual carriers—which are between the perforation lines 44 and side edges of the web 43, and between the perforations 33 and the side edges of the web 32—have a second surface area which is greater than the first surface area (the surface area of the card 12). However in the preferred embodiment according to the invention it is desirable that the second surface area not be enormously larger than the first surface area, since it is desired to merely package the card 12 and not perform other functions with the carrier. Therefore in the preferred embodiment the dimensions of each of the final carriers produced—indicated by reference numeral 58 in FIG. 7—is (for a card 12 having the dimensions described above) about 4.2 inches by 3 inches, so that the second surface area is less than twice as great as the first surface area.

After step 52, webs 42 and 43 are aligned, as indicated schematically at 60 in FIG. 1, so that the control number 16 of each card 12 mounted on the first carrier web 32 is aligned with the cutout 50, and the perforation lines 44 are aligned with the perforation lines 33, and perforation lines 47, 35 are also aligned. If necessary, the aligned webs may then be passed to step 61 where the permanent adhesive patterns 53–55 are activated (e.g. if the patterns 53–55 are pressure activated adhesive rather than hot melt adhesive, for example), and then the final web produced—illustrated generally by reference numeral 62 in FIGS. 7 and 8—is folded certain number of carriers 58. For example if the carriers 58 each have a dimension in the directions 34, 45 of three inches, the web 62 may be folded every twelve inches (that is along the perforation lines 33,44 of every fourth carrier 58), in a zigzag, festooning arrangement.

Optionally, but preferably, prior to the webs 32, 43 passing to the steps 31, 42, respectively, the webs are printed—at least the external faces thereof are printed. For example as indicated schematically at 64 in FIG. 1 the external face 65 of first web 32 is multi-color ion deposition primed with the same designs and indicia 19, 20 as on the card 12 from face 18 (see FIG. 3), in a manner that simulates the card 12 front face 18, that is having a perimeter 66 of approximately the same size and shape as the card 12. The perimeter 66 almost exactly corresponds to and is aligned with the perimeter of the real card 12 and repositional adhesive 27 disposed on the internal face 40 of the web 32. As illustrated schematically at 68 in FIG. 1 prior to step 42 the external face 69 of the second web 43 (see FIG. 8) may be printed with instructional or other non-confidential indicia, illustrated schematically only at 70 in FIG. 8.

As seen in FIGS 7 and 8, particularly FIG. 8, confidential indicia 14 on the rear face 13 of the card 12 is not visible from the exterior of the carrier 58, however the non-confidential control number 16 is visible through the cutout 50. Typically the carriers 58 are separated along the perforation lines 44 and distributed.

When the individual receiving a carrier 58 desires to open it, this is easily accomplished by tearing along the perforation lines 35, 47 adjacent the right end of the web 58 as viewed in FIG. 7 (left end as viewed in FIG. 8), the perforations 35, 47 being on the opposite side of the glue strip 55 from the edges 46, 36. This allows the user to insert his/her finger between the second ply 43 and the back face 13 of the card 12 and grip the second ply 43 and pull back, as indicated for the top carrier 58 in FIG. 8 separating the paper that was held by the glue dots 53, leaving the torn/residue area 71 illustrated in FIG. 8. Then the user grasps a comer of the card 12 and peels it away from the repositional adhesive 27. The repositional adhesive 27 has a greater affinity for the sheet 28 (and thus the internal face 40 of the first ply 32) than it does for the front face 18 of the card 12, therefore substantially no adhesive residue remains on the card 12 when it is removed from the carrier 58. Of course the perforations 35,47 provide a tamperproof function also, clearly indicating if someone has opened up the carrier 58, which may have compromised the security of the confidential information 14.

It will thus be seen that according to the present invention an effective method has been provided for constructing carriers for cards. The indicia on the cards can be such as to make the card a toll pass, transportation pass, bank card, cafeteria meal card, prepaid vending card, phone card, debit card, credit card, etc. of either paper stock (which is discarded after a relatively short period of time), or plastic stock (such as a credit card). The invention also relates to an advantageous carrier so produced.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and products.

What is claimed is:

1. A combination of a card carrier for transport of a card having confidential and non-confidential indicia thereon so that the confidential indicia is not visible and the non-confidential indicia is visible from the exterior of the card carrier, and a card, said combination comprising:

a card, of paper or plastic card stock, having first and second faces, said second face having first non-confidential indicia thereon and at least one of said faces having confidential indicia thereon, said card of generally quadrate configuration and having a first surface area of each of the faces thereof;

a first opaque paper carrier ply having an external face and an internal face, said faces each having a second surface area larger than said first surface area;

repositional adhesive adhered to said first carrier ply internal face in a central portion thereof, said repositional adhesive disposed within a perimeter having approximately the same size and shape as said card, and said repositional adhesive having a greater affinity for said carrier ply than for said card first face;

said card first face in engagement with said repositional adhesive;

a second opaque carrier ply having an external face and an internal face, said faces each having approximately said second surface area, and said second ply having a cutout therein of approximately the same size and shape as said first non-confidential indicia on said card second face;

permanent adhesive patterns disposed around the periphery of one or both of said internal faces of said first and second plies, outside of said perimeter of said repositional adhesive;

said second ply disposed so that the internal face thereof is in face-to-face engagement with said card second face and said first ply internal face with said cutout aligned with said first non-confidential indicia so that said first non-confidential indicia is visible from the exterior of said carrier, and so that said permanent adhesive patterns hold said first and second carrier plies together; and tamperproof means facilitating separation of said first and second plies to allow access to and removal of said card from said repositional adhesive and between said plies.

2. A combination as recited in claim 1 wherein said confidential indicia comprises a personal identification number imaged on said card second face remote from said first non-confidential indicia.

3. A combination as recited in claim 1 wherein said first carrier ply external face has indicia thereon simulating said first face of said card, and of approximately said first surface area.

4. A combination as recited in claim 3 wherein said second surface area is less than twice as large as said first surface area.

5. A combination as recited in claim 1 wherein said tamperproof means facilitating separation of said first and second plies comprises aligned perforation lines disposed in said first and second plies located between an edge of said card and one of said patterns of permanent adhesive.

6. A combination as recited in claim 5 wherein said permanent adhesive patterns comprises a plurality of spaced dots of permanent adhesive disposed along two opposite edges of one or both of said first and second plies, and a pair of permanent adhesive strips disposed along two other opposite edges of one or both of said first and second plies, said perforation lines disposed adjacent one of said adhesive strips.

7. A combination as recited in claim 1 wherein said repositional adhesive is affixed to a first face of an internal ply having approximately the same size and shape as said card, and wherein a second face of said internal ply is connected by permanent adhesive to said internal face of said first ply, said internal ply first face having greater affinity for said repositional adhesive than does said card first face.

8. A combination as recited in claim 1 wherein said card first face has multiple color, decorative ion deposition printed indicia thereon.

9. A combination as recited in claim 8 wherein said card comprises a 6 to 15 point stock gloss finish paper card stock.

10. A combination as recited in claim 9 wherein said first carrier ply external face has indicia thereon simulating said first face of said card, and of approximately said first surface area.

11. A combination as recited in claim 1 connected in a web with a plurality of like carriers, said web elongated in a first direction, and said carriers being separated within said web by perforation lines extending through both said first and second plies substantially perpendicular to said direction of elongation.

12. A combination as recited in claim 1 wherein said card has confidential and non-confidential indicia thereon making said card a toll pass, transportation pass, cafeteria meal card, pre-paid vending card, phone card, bank card, debit card, or credit card.

13. A combination of a card carrier for transport of a card having confidential and non-confidential indicia thereon, and a card, said combination comprising:

a card, of paper or plastic card stock, having first and second faces, said second face having first non-confidential indicia thereon and at least one of said faces having confidential indicia thereon, said card of generally quadrate configuration and having a first surface area of each of the faces thereof;

a first opaque paper carrier ply having an external face and an internal face, said faces each having a second surface area larger than said first surface area;

repositional adhesive adhered to said first carrier ply internal face in a central portion thereof, said repositional adhesive disposed within a perimeter having approximately the same size and shape as said card, and said repositional adhesive having a greater affinity for said carrier ply than for said card first face;

said card first face in engagement with said repositional adhesive;

a second opaque carrier ply having an external face and an internal face, said faces each having approximately said second surface area;

permanent adhesive patterns disposed around the periphery of one or both of said internal faces of said first and second plies, outside of said perimeter of said repositional adhesive;

said second ply disposed so that the internal face thereof is in face-to-face engagement with said card second face and said first ply internal face, and so that said permanent adhesive patterns hold said first and second carrier plies together; and wherein said first carrier ply external face has indicia thereon simulating said first face of said card, and of approximately said first surface area.

14. A combination as recited in claim 13 wherein said second surface area is less than twice as large as said first surface area.

15. A combination as recited in claim 14 wherein said card first face, and said first carrier ply external face, have multiple color, decorative ion deposition printed indicia thereon.

16. A combination as recited in claim 1 wherein said second surface area is less than twice as great as said first surface area.

17. A combination as recited in claim 13 wherein said card has confidential and non-confidential indicia thereon making said card a toll pass, transportation pass, cafeteria meal card, pre-paid vending card, phone card, bank card, debit card, or credit card.

18. A combination as recited in claim 15 wherein said card comprises a 6 to 15 point stock gloss finish paper card stock.

19. A combination as recited in claim 13 wherein said card comprises a 6 to 15 point stock gloss finish paper card stock.

* * * * *